United States Patent [19]

Phillips

[11] Patent Number: 4,959,980

[45] Date of Patent: Oct. 2, 1990

[54] STORAGE DRUM SECURITY DEVICE

[76] Inventor: Mark S. Phillips, 510 Budd Ave., Campbell, Calif. 95008

[21] Appl. No.: 450,169

[22] Filed: Dec. 13, 1989

[51] Int. Cl.[5] ..... B65D 55/14

[52] U.S. Cl. ..... 70/158; 70/164; 70/180

[58] Field of Search ..... 70/158, 173, 174–181, 70/232

[56] References Cited

U.S. PATENT DOCUMENTS

| | | | |
|---|---|---|---|
| 1,599,685 | 9/1926 | Spaeth | 70/164 X |
| 1,762,582 | 6/1930 | Nunes | 70/180 |
| 1,806,124 | 5/1931 | Smith | 70/158 X |
| 1,814,343 | 7/1931 | Smith | 70/180 X |
| 1,825,726 | 10/1931 | Gredell | 70/164 X |
| 1,996,182 | 4/1935 | Walker | 70/180 X |
| 3,564,879 | 2/1971 | Bennett | 70/232 |
| 3,593,549 | 7/1971 | Lakins | 70/164 |
| 4,592,218 | 6/1986 | Chechovsky et al. | 70/164 |
| 4,655,060 | 4/1987 | Jakubas | 70/164 X |
| 4,788,840 | 12/1988 | Wilson, Jr. | 70/164 |

*Primary Examiner*—Robert L. Wolfe
*Assistant Examiner*—Suzanne L. Dino
*Attorney, Agent, or Firm*—Michael J. Hughes

[57] ABSTRACT

A storage drum security apparatus (10) is provided to secure the apertures (24,26) on a storage drum or barrel (12). The apparatus (10) includes a large aperture subassembly (14) and a small aperture subassembly (16) which are interconnected by a securing bar subassembly (18). The first bung member (28) is provided with a post member (40) which extends upward through an isolator member (56) to engage a post receiving hole (98) formed in a flattened portion (92) of the securing bar (90) while the second bung member (66) includes a ball portion (80) on a neck (78) which mates with ball receiving structure (102) in the tubular portion (94) of the securing bar (90). This relationship prevents access to turn either of the bung members (28,66) while the securing bar (90) is in place. The securing bar (90) is also adapted to be used as a wrench to turn both the bung members (28,66) when desired. The primary usage of the apparatus (10) is in connection with conventional 55 gallon drums, wherein the apparatus (10) is useful in preventing petty pilferage and spillage, but is also adaptable for use in other circumstances wherein it is desirable to secure spaced-apart coplanar apertures.

16 Claims, 4 Drawing Sheets

STORAGE DRUM SECURITY DEVICE

TECHNICAL FIELD

The present invention relates generally to security devices and more specifically to devices which restrict access to apertures of various kinds. The preferred embodiment of the present invention is specifically adapted for securing the stopper members ("bungs") on liquid filled drums such as those utilized for petroleum and chemical products and for various food items.

DESCRIPTION OF THE PRIOR ART

A very substantial number of liquids in the petroleum and chemical fields as well a reasonable number of flowable solids are packaged in large drums for shipment and storage. In the United States particularly, the standard transfer and storage container is a barrel-shaped 55-gallon drum. The typical drum is constructed of metal, or in some cases heavy-gauge plastic, and is provided with a pair of apertures or bungholes on at least one of the end surfaces. Typically, the drum will be stored with the surface having the apertures being the top of the drum.

In many industries, particularly the semiconductor and chemical manufacturing industries, the contents of the storage drums may be either or both extremely hazardous or very expensive. As such, it is very important to maintain high quality security with respect to these contents. In addition, for common drum contents such as petroleum products in the nature of motor oil, kerosene and the like, it is not uncommon for employees or casual passers-by to engage in minor pilferage of quantities of these contents for their own usage. For these purposes also, it is desirable to have a method of securing the contents of the drum.

Certain large drums are enclosed by having a removable end cap of the entire end of the barrel. Although the present invention is not directed to securing the entire end cap, a drum security device known as a "Barrel Lock Assembly" is the subject of U.S. Pat. No. 4,704,881, issued to Clifford Sloop, Sr. This device illustrates a method for preventing removal of the entire end cap.

The nature of drums to which the present invention is directed are those which include the two apertures or bungholes on the end surface, which are typically closed off by screw-type caps or bungs which are inserted therein. Although the structures and dimensions vary, typically, the two apertures will be of different sizes with a large aperture having a diameter of 50 mm (2 in) and a small aperture having a diameter of 19 mm (¾ in). Conventional threaded bungs, stoppers or bung caps are adapted to mate with the apertures during shipment and storage and may be removed and replaced with hardware such as pump hardware when it is desired to remove the contents of the drum.

U.S. Pat. No. 4,592,218, issued to D. Chechovsky et al., illustrates one attempt at a security device for a screw-type bung or cap in the nature similar to that utilized on storage drums. This patent describes a tank closure lock which is adaptable for use on each of the caps separately.

Another, commercially available, device which is utilized specifically as a security device for storage drums is that known as "DRUMLOCK" which is distributed by Taurus Precision, Inc. of Fairfield, New Jersey. This device utilizes a pair of heavy replacement bung caps which are screwed into the bungholes and are then connected by a solid bar which is slid through holes in each of the bung caps. The bar may then be locked so that it may not be removed, thus preventing the bung caps from being unscrewed and removed from the drum. This has proved to be a very effective security device that may be described as a "maximal" solution but does not meet all of the objects of an ideal security device.

Some other prior art mechanisms which have been designed for protecting openings into barrels or tanks, but which are not directly applicable to the present invention, are described in U.S. Pat. No. 3,593,549, issued to Frederick Lakins et al.; U.S. Pat. No. 4,254,888, issued to James Chandler; and U.S. Pat. No. 4,466,259, issued to Gordon Osgood, Sr. These references disclose methods of limiting access to tank caps or bungs but do not specifically address the problems inherent with drum-type storage.

Although, as described above, various attempts have been made to solve the problems inherent in security for liquid and flowable solid storage, none have been entirely successful. All have failed in one manner or another in that they have not been economical, have required that the caps be aligned in a particular orientation so that they might not be tightened properly, do not allow for separate locking of either of the bung members without securing the other, or have required complex tools or modifications of the drums themselves in order to allow usage.

BRIEF DESCRIPTION OF THE INVENTION

It is therefore an object of the present invention to provide a device which will easily and securely prevent unauthorized access to the apertures of a drumlike container.

It is another object of the present invention to provide a device which, in combination with a simple lock, may restrict access to the contents of a drum.

It is a further object of the present invention to provide a security device for drumlike containers in which minimal modifications are required to the standard drum closing hardware.

It is further object of the present invention to provide a securing device which may also be utilized as a tool for tightening and loosening the bung members.

It is still another object of the present invention to provide an inexpensive and simple security device for drumlike containers.

The present invention is a storage drum security device especially adapted for utilization with drumlike containers, such as the conventional fifty five gallon drum. Containers of this nature have a pair of apertures formed on one end surface with, ordinarily, a large bung member and a small bung member occluding the two apertures. The inventive device involves replacing the standard bung members with custom designed bungs which are adapted to mate with securing hardware in such a manner that an easily releasable security closure is formed. The construction and operation of the device makes it possible to restrict access to both bungs with a single fastener.

Briefly, a preferred embodiment of the present invention is a storage drum security device which is adapted for use with multiple aperture surfaces in which it is desired to restrict access to elements situated behind or beneath the apertures. In particular, the preferred embodiment is especially adapted for use with standard fifty five gallon drums having a large aperture and a small aperture on the top or end wall surface.

The preferred embodiment of the storage drum security apparatus includes a large aperture subassembly which is adapted to mate with and seal the large aperture of the storage drum, also known as the large bunghole; a small aperture subassembly which is adapted to mate with and seal the small aperture or the small bunghole; and a securing bar subassembly which extends between the aperture subassemblies to tie them together in such a manner that neither aperture is accessible when the securing bar subassembly is locked in place. A conventional lock of any of a variety of mechanisms is also utilized to secure the device in place on the drum.

An advantage of the present invention is that it efficiently and economically restricts assess to storage drums and similar multi-aperture components.

Another advantage of the present invention is that the device is constructed such that the occluding bung members may not be unscrewed or removed from the bungholes without first removing the securing bar.

A further advantage of the present invention is that the isolator members provided over the bung members spin freely with respect to the bung members and thus provide protection without concurrently providing a point of access for bung removal.

Still another advantage of the present invention is that the securing bar may also be utilized as a tightening and loosening wrench for both the large and small bung members.

Yet another advantage of the present invention is that the rotational position of the bung members is not critical to the operation of the security device, that is, they may be turned any degree of tightness or looseness desired, while permitting the securing device to operate properly, without requiring a specific orientation for attachment.

A still further advantage of the present invention is that it provides reasonable security without being unduly bulky or heavy.

Still another advantage of the present invention is that the bung members bear a strong resemblance to conventional bung members and may be utilized without the securing bar subassembly during those periods in which ready access to the apertures is desired.

A further advantage of the present invention is that it will operate effectively with warped or distorted drums, since the tolerances allow moderately nonplanar arrangements.

Yet another advantage of the present invention is that one aperture, usually the large aperture, may be secured separately, without requiring both apertures to be simultaneously secured.

These and other objects and advantage of the present invention will become clear to those skilled in the art upon a review of the following description, the accompanying drawings and the appended claims.

BEST MODE OF CARRYING OUT THE INVENTION

The preferred embodiment of the present invention is a storage drum security apparatus adapted for restricting access to a pair of spaced-apart apertures lying generally in the same plane. The particular preferred embodiment of the storage drum security apparatus is adapted for use with conventional fluid shipment and storage drums such as the fifty five gallon drum which is standard in most American petroleum and bulk chemical transfer operations. The apparatus is intended to provide an easily installed and removed security device which effectively puts a stop to petty pilfering and unwarranted spillage due to carelessness while also providing at least moderate discouragement to determined larceny.

Figure 1:
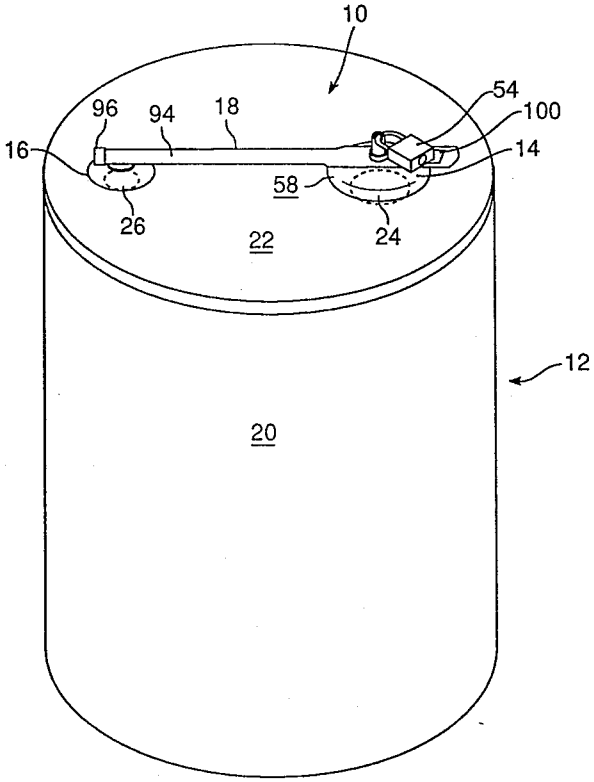
FIG. 1 is a perspective view of a preferred embodiment of the storage drum securing apparatus shown as installed upon a typical storage drum;.

Referring now to FIG. 1, the storage drum security apparatus of the preferred embodiment is illustrated in a perspective view and referred to by the general reference character 10. In the illustration of FIG. 1, the security apparatus 10 is shown as installed on a conventional storage drum 12. From the illustrations of both FIG. 1 and FIG. 2 it may be seen that the security apparatus 10 includes a large aperture subassembly 14, a small aperture subassembly 16 and a securing bar subassembly 18. The subassemblies 14, 16 and 18 work together to perform a complete security apparatus for the storage drum 12.

As is shown in FIG. 1, the conventional storage drum 12 includes a barrel portion 20 in which a liquid, powder or other flowable material is ordinarily transported and stored. The barrel portion 20 has a pair of opposing end wall surfaces 22, at least one of which is provided with a large aperture 24 (also known as a first bunghole 24) and a small aperture 26 (also known as a second bunghole 26). In a typical usage the large aperture 24 and the small aperture 26 are both opened to allow delivery of the contents of the storage drum 12 to whatever destination is desired. Typically in a fluid transfer step, the small aperture 26 provides an air inlet which allows for proper flow or pumping of the fluid contents through the large aperture 24.

Figure 2:
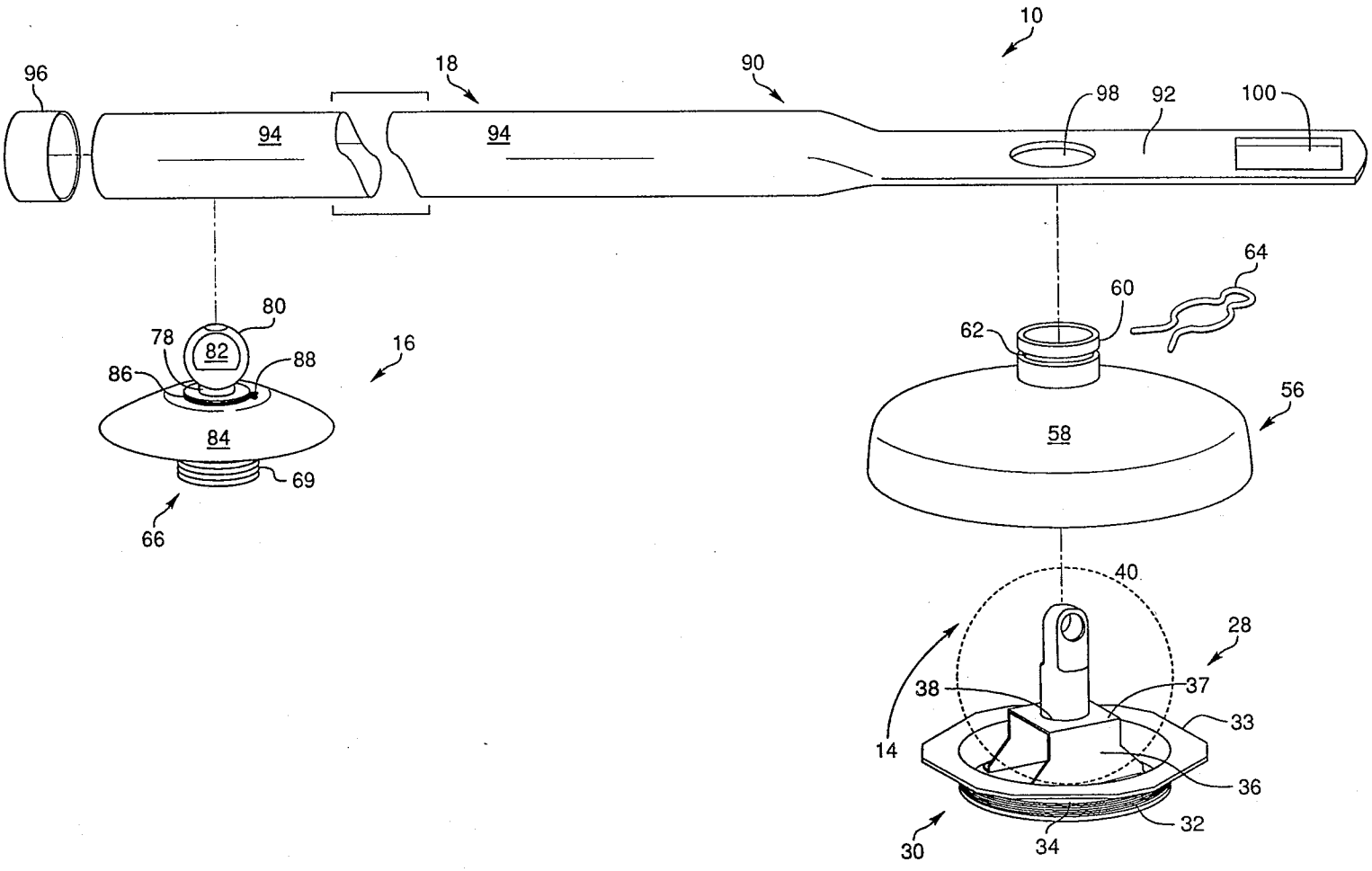
FIG. 2 is an exploded perspective view of the preferred embodiment of FIG. 1.

As is understood from the view of FIG. 1, the large aperture subassembly 14 is adapted to mate with the large aperture 24 in order to seal the large aperture 24 and prevent access to the contents of the drum 12. As shown in FIG. 2, the large aperture subassembly includes a first bung member 28 which is adapted to screw into the threads which are typically present in the large aperture or large bunghole 24. The first bung member 28, particularly in its portions which mate with the large bunghole 24, is substantially similar or identical to conventional bungs or caps which are utilized with the drums 12. The first bung member 28 includes a cap portion 30, which is essentially conventional, in that it includes threads 32 adapted to mate with the threads of the large aperture 24. The cap portion 30 also includes a rim 33, usually octagonal, by which the bung member 28 may be turned to be screwed into or out of the bunghole 24. The threads 32 of the cap portion 30 are ordinarily provided with a washer 34 which aids in forming a tight seal with the drum 12.

The area in which the first bung member 28 differs from that of the conventional type is that the upper interior surface of the cap portion 30 is provided with a post support member 36. The post support is substantially in the form of a raised structure which is securely mounted within the cap portion 30. Typically, the post support 36 is welded into the cap portion 30 so as to be firmly attached thereto and resistant to detachment as a result of either twisting or pulling forces. The post support 36 culminates in a platform 37 situated a distance above the rim 33. A horizontal cross section of the post support 36 yields a square shape, suitable for being grasped by a box wrench for aiding in turning the first bung member 28. The post support 36 has formed, on its platform portion 37, a circular post hole 38 which is adapted to receive a post member 40.

Figure 5:
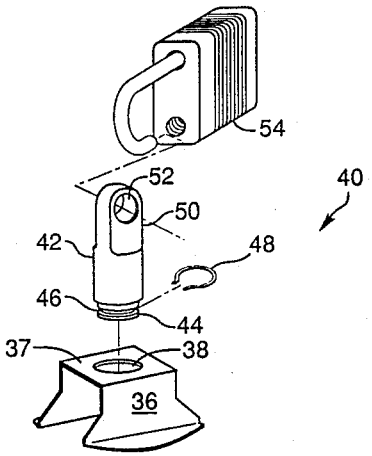
FIG. 5 is an exploded perspective view of the structure shown in the highlight circle in FIG. 2.

The post member 40, which is particularly shown in FIG. 5, includes a main cylinder portion 42 which has a diameter greater than that of the posthole 38. A bottom cylinder portion 44, extending below the main cylinder portion 42, has a diameter less than that of the main cylinder portion 42. A radial groove 46 is formed at a position along the bottom cylinder portion 44 which is displaced from the intersection of the bottom cylinder portion 44 and the main cylinder portion 42 by a distance greater than the thickness of the post support member 36. The radial groove 46 is adapted to receive a lock ring 48 which slidably fits over the post member 40 and into the radial groove 46. The lock ring 48 is placed into position after the bottom cylinder portion 44 is inserted through the post hole 38. The lock ring 48 prevents the post member 40 from being removed from the post support 36, while allowing the post member 40 to spin freely within the post hole 38. This freedom of spin prevents the post member 40 from being used as a lever to turn the bung member 28, and thus to gain access to the first aperture 24.

At the end of the post member 40 opposite the bottom cylinder 44, a flattened portion 50 is provided with a lock hole 52 extending therethrough. The lock hole 52 is adapted to receive the bolt portion of a conventional padlock 54 of the user's choice.

In addition to the first bung member 28 and the padlock 54, the large aperture subassembly 14 includes an isolator member 56. The isolator member 56 is in the form of a cover which mates with the surface of the end wall 22 to effectively prevent access to all portions of the first bung member 28 except for the post member 40. This prevents the cap portion 30 from being unscrewed from the large aperture 24 when the isolator member 56 is in place and thus effectively restricts access to the contents of the drum 12.

The isolator member 56 includes a cover portion 58 which is generally in the form of a hollow flattened hemisphere or the round end of a hollow ellipsoid. The cover portion 58, also known as the dome 58, extends completely around the cap portion and has a flat bottom edge to rest against the surface of the end wall 22. The cover portion 58 is also sufficiently broad that it does not intersect any of the cap portion 30. This isolation is important so that spinning the cover portion 58 has no effect on turning the cap portion 30. The center top of the cover portion 58 is provided with a tube 60. The tube 60 is hollow and is adapted for receiving the post member 40 therethrough. The inside diameter of the tube 60 is slightly greater than the outside diameter of the post member 40 such that the post member 40 may turn freely with respect to the isolator member 56, and vice versa.

The exterior of the tube portion 60 is provided with a detent ring groove 62 extending therearound. The detent ring groove 62 is situated a short distance above the intersection of the tube portion 60 with the cover portion 58. The detent ring groove 62 is adapted to receive a hairpin clip 64, the purpose of which will be discussed hereinafter with respect to the securing bar subassembly 18.

Figure 3:
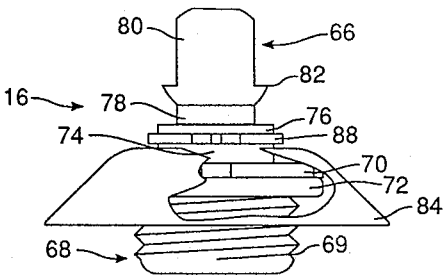
FIG. 3 is a partially cut-away front elevational view of the small aperture subassembly.

Referring now to FIGS. 2 and 3, the structure of the small aperture subassembly 16 will be discussed. The small aperture 16 includes a second bung member 66 which is adapted to mate with the small aperture 26 or the second bunghole 26 in order to close the aperture. The usual usage of the small aperture 26 is as an air inlet utilized to equalize pressure or to provide pressure when connected to a pressure hose in order to facilitate pouring or pumping through the large aperture 24. Although the small aperture 26 is not a primary access source for the liquid, it is usually desirable to secure this as well to prevent siphoning or inadvertent fluid loss.

The second bung member 66 is similar to conventional small aperture bung members in that it includes a screw cap portion 68 having threads 69 which are adapted to mate with the internal threads of the small aperture 26. Situated above the threads 69 is a rim 70 (which is typically octagonal but may be any shape), which in a conventional bung member, would provide the portion which would be turned by a wrench or other tool to tighten or loosen the bung member. The rim 70 also provides a shoulder to support washer 72 which is provided on the threads 69 below the rim 70 to secure the seal between the second bung member 66 and the storage drum 12.

In the preferred embodiment 10 the second bung member 66 is provided with a shoulder portion 74 which is rigidly attached to the cap portion 68 and extends upward from the center of the rim 70. Near the top of the shoulder portion 74 it is provided with a ring channel 76 in the form of a circumferential indentation. A neck portion 78, narrower than the shoulder portion 74, extends upward and culminates in a ball portion 80. The ball portion 80 is generally spherical and has a diameter greater than the thickness of the neck portion 78. Two opposing sides of the ball portion 80 are provided with wrench flats 82 which allow the second bung member 66 to be gripped by a wrench or the like or by securing bar subassembly 18 (as discussed hereinafter) for screwing and unscrewing from the small aperture 26.

Just as the isolator member 56 prevents access to the cap portion 30 of the first bung member 28, an isolating cover 84 is provided to prevent access to the screw cap portion 68 of the second bung member 66. The isolating cover 84 is a plate in the general shape of a sector of a sphere or a hollow truncated cone having an installation hole 86 in the middle for receiving the shoulder portion 74 of the second bung member 66. The installation hole 86 has a diameter greater than that of the ball portion 80 so that it may be placed on the second bung member 66 for installation. The isolating cover 84 is then held in place by placing a locking ring 88 in the ring channel 76. This sort of installation allows the isolating cover 84 to rotate freely with respect to the second bung member 66. In this manner, the interaction between the isolating cover 84 and the end wall surface 22 of the drum 12 prevents the second bung member 66 from being turned except by the wrench flats 82 on the ball portion 80.

Figure 4:
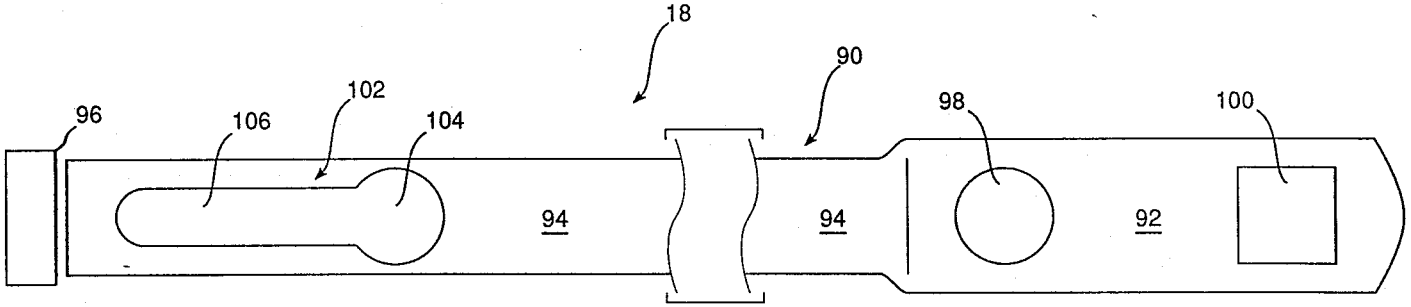
FIG. 4 is a bottom plan view of the securing bar subassembly.

The final major component of the storage drum security apparatus 10 is the securing bar subassembly 18, which is best understood from the illustrations of FIGS. 1, 2 and 4. FIG. 1 illustrates the manner in which the securing bar subassembly 18 is applied in use on the storage drum 12. FIG. 2 illustrates the locational interaction between the securing bar subassembly 18, the large aperture subassembly 14, and the small aperture subassembly 16. FIG. 4 is a bottom plan view of the securing bar subassembly 18, showing some of the features which may not be clearly seen in the other views.

The securing bar subassembly 18 includes a bar member 90 which has a flattened bar portion 92 at one end and a tube portion 94 providing the majority of its length. The open end of the tube portion 94, that is, that end farthest removed from the bar portion 92, is provided with an end cap 96 for esthetic and safety purposes. The end cap 96 is typically a plastic or rubber cap which is merely used to prevent contact with the exposed surfaces of the end of the tube portion 94. A solid end may be desirable in some instances to prevent access to the interior of the tube portion 94.

The flattened bar portion 92 has two apertures formed therein. The first of these is a post receiving hole 98 which is adapted to receive the tube 60 of the isolator member 56 and, consequently, the post member 40 of the first bung member 28. The diameter of the post receiving hole 98 is slightly larger than the outside diameter of the tube 60 so that easy installation is possible and also so that the isolator member 56 may rotate freely with respect to the bar member 90.

The second aperture provided in the flattened bar portion 92 is a square hole 100 which is utilized as a wrench. The dimensions of the square hole 100 are adapted to match the outside dimensions of the post support 36 so that the bar member 90 may be utilized as a wrench to turn the first bung member 28. This allows tightening and loosening the first bung member 28 within the large aperture 24 and permits access to the contents of the storage drum 12 when desired.

As shown in FIG. 4, the lower surface of the tube portion 94 includes a ball receiving structure 102 which is adapted to mate with the ball portion 80 of the second bung member 66. The ball receiving structure 102, which is aligned with the flat surface of the underside of the bar portion 92 such that the bar receiving structure 102 is open downwardly at the same time that the post receiving hole 98 is aligned downwardly, includes a circular aperture 104 and a sliding channel 106 which extends away from the circular aperture 104 toward the end cap 96. The diameter of the circular aperture 104 is selected to be slightly greater than the diameter of the ball portion 80 while the width of the sliding channel 106 is selected to be greater than that of the neck portion 78 but less than the diameter of the ball portion 80, including the span between the lower edges of the wrench flats 82. This spacing is desirable because it allows the ball portion 80 to be inserted into the interior of the tube portion 94, but when the neck portion 78 is received within the sliding channel 106, the second bung member 66 may not be removed from the bar member 90. The specific width of the sliding channel 106 is selected so that it fits closely over the wrench flats 82, thus allowing the use of the securing bar 18 as a wrench to tighten or loosen the second bung member 66.

In the preferred embodiment, the device 10 is utilized specifically with use of a 55-gallon conventional drum 12. For this utilization, the dimensions are selected to correspond to those of the drum. For example, the cap portion 30 of the first bung member 28 is selected to have a diameter of 75 mm ($2\frac{7}{8}$ in) while the screw cap portion 68 of the second bung member 66 has a diameter of 40 mm ($1\frac{1}{2}$ in).

The bar member 90 is selected to have a length of 552 mm (22 in) with the distance between the post receiving hole 98 and the circular aperture 104 being approximately 375 mm (15 in). This span is selected because the typical separation between the first aperture 24 and the second aperture 26 on the storage drum 12 is 441 ($17\frac{1}{2}$ in). Thus, when the bar member 90 is installed the ball portion 80 will be well situated within the sliding channel 106 when the post receiving hole 98 is placed over the post member 40.

Typically, the storage drum security apparatus 10 will be manufactured out of carbon steel. Certain elements, such as the isolator member 56, particularly the cover portion 58, may be formed of high impact plastic such as Lexan (Trademark). The end cap 96 may be plastic or rubber or may be eliminated altogether or may be replaced by a solid end portion. Of course, other materials and dimensions may be utilized or substituted without detracting from the purpose and usability of the invention.

Those skilled in the art will readily observe that numerous other modifications and alterations of the assembly and its components may be made while retaining the teachings of the invention. Accordingly, the above disclosure is not intended as limiting. The appended claims are therefore to be interpreted as encompassing the entire spirit and scope of the invention.

INDUSTRIAL APPLICABILITY

The storage drum security apparatus 10 of the present invention and the alternate embodiments are particularly adapted for use in protecting apertures which all lie generally on the same surface. Although the primary expected usages are with conventional storage drums, there is no reason that the device cannot be equally useful in protecting any other set of separated apertures, such as those which might be found on a security plate protecting a control panel. The preferred embodiment 10 has been described specifically in terms of hardware which is adapted to mate with a standard storage drum 12. However, the types of interaction between the large aperture subassembly 14 and the large aperture 24 and the small aperture subassembly 16 and the small aperture 26, respectively, may be adjusted in order to meet the needs of any particular set of apertures.

For the sake of example only, the utilization of the storage drum security apparatus 10 with a conventional 55-gallon drum 12 is described below. For the purposes of discussion, it is assumed that the storage drum 12 is round in a situation where both the first bunghole 24 and the second bunghole 26 are open. In this situation it is desired to seal and secure the storage drum 12 so that there may be no pilferage or accidental spillage.

Initially, the bung member 28 is screwed into the first bung hole 24 to the degree of tightness desired. This may be accomplished by utilizing the securing bar 90 as a wrench. The square aperture 100 is adapted to fit easily over the post member 40 and the post support structure 36. The interaction between the square aperture 100 and the post support member 36 may then be utilized to turn the first bung member 28 to the desired degree of tightness. After the proper degree of tightness has been achieved the isolator member 56 may be installed over the first bung member 28 with the post member 40 extending through the tube 60. The hairpin clip 64 is not utilized at this stage. Alternatively, the isolator member 56 may be left attached to the securing bar 90 and placed on the first bung member 28 at a later stage.

Similarly, the second bung member 66 is installed within the second bung hole 26 to the desired degree of tightness. This may be accomplished by using the securing bar 90 as a wrench, with the sliding channel 102 acting to grip the wrench flats 82. When the second bung member 66 is sufficiently tight then the securing bar 90 is placed onto the second bung member by arraying the securing bar 90 such that the circular aperture 104 is slid down over the ball portion 80. The securing bar 90 is then slid in such a manner that the neck portion 78 is contained within the sliding channel 106 and the ball portion 80 is securely within the tube portion 94. The dimensions of the neck portion 78 and the sliding channel 106 are such that a certain amount of vertical freedom is allowed to the securing bar 90 while the second bung member 66 is engaged. This allows the user to maneuver the bar portion 92 over the large aperture subassembly 14.

The bar member is then maneuvered until the post receiving hole 98 is situated above the tube 60 and the post member 40 which extends therethrough. The bar portion 92 is then lodged onto the large aperture subassembly 14 by sliding the post receiving hole 98 down the outside of the tube 60 to as rest against the upper surface of the cover portion 58 of the isolator member 56. The thickness of the bar portion 92 is less than the distance between the cover portion 58 and the detent ring groove 62 on the tube 60. Therefore, the detent ring groove 62 will be positioned above the bar portion 92 when the securing bar subassembly 18 is in place. The hairpin clip 64 may then be placed on the tube 60 to retain this positioning.

In order to complete the securing of the apparatus 10, the padlock 54 is then placed through the lock hole 52 of the post portion 40. The dimensions of the padlock 54 thus prevent the securing bar 90 from being removed from the post 40 and completely restrict access to either of the apertures 24 or 26.

When access is again desired to the contents of the drum 12, the above process is simply reversed.

An alternative method may be utilized in which the hairpin clip 64 is utilized to retain the isolator member 56 on the securing bar 90 throughout. This combination does not interfere with the use of securing bar 90 as a wrench (the bar 90 is simply turned so that the cover portion 58 faces outward). Furthermore, the isolator member 56 allows the securing bar 90 to be conveniently hung on the rim of the barrel for easy access.

Because the drum security apparatus 10 of the present invention provides several advantages such as ease of use, simplicity of construction, and economy of manufacture, it is expected that a substantial market therefor will exist in industry. The industrial applicability and commercial viability of the present invention are therefore expected to be substantial.

I claim:

1. A security device adapted for use with multiple aperture surfaces including at least a first aperture and a second aperture arrayed so as to be generally coplanar, comprising:

a first bung member adapted to releasably mate with the first aperture, the first bung member including a first projection which extends therefrom exteriorally from the surface;

a second bung member adapted to releasably mate with the second aperture, the second bung member including a second projection which extends therefrom exteriorally from the surface, said second projection including a narrow intermediate portion and a broad terminal portion;

an isolator member for extending over the first bung member and interrelating to the surface in such a manner that the preponderance of the first bung member is inaccessible from the exterior of the isolator member, said first projection extending through the isolator member; and an elongated securing member for extending between the first bung member and the second bung member, the securing member engaging both said first projection and said second projection, with the engagement with one of said projections being inaccessible from the exterior of the engagement member and not subject to disengagement as long as the engagement is maintained with the other of said projections, the engagement with the other of said projections being adapted to securing with a locking means for attaching the securing member in place such that neither aperture is accessible while such attachment is maintained; and wherein the elongated securing member includes an aperture extending therethrough for receiving said first projection and a receiving structure axially separated from said aperture, said receiving structure being adapted to receive a terminal portion of said second bung member into the interior of the securing member, said receiving structure including a receiving aperture having an opening adapted to permit passage therethrough of said terminal portion and a sliding channel extending outwardly from said receiving aperture, said sliding channel having a width greater than that of said intermediate portion but less than that of said terminal portion so that when the securing member is slid such that said intermediate portion is within said sliding channel the securing member may not be detached from the second bung member.

2. The device of claim 1 wherein the first bung member and the second bung member are include threaded portions for mating with interior threading within the respective apertures;

said first projection is mounted so as to spin freely with respect to said threaded portion.

3. The device of claim 2 wherein the second bung member further includes an isolating cover intermediate said respective threaded portion and the terminal end of said second projection, said isolating cover restricting access to said threaded portion when the second bung member is engaged with the second aperture.

4. The device of claim 1 wherein clip means are provided for releasably attaching the isolator member to the elongated securing member.

5. A storage drum security device comprising:

a first bung subassembly adapted to mate with a first aperture on the surface of the storage drum, the first bung subassembly including a first bung member having a first threaded portion for threadably screwing into the first aperture, said first bung member further including a post portion extending axially outward therefrom and having means for receiving a locking device, and an isolator member for slidably fitting over said post member so as to restrict access to said threaded portion and to the first aperture;

a second bung subassembly adapted to mate with a second aperture on the surface of the storage drum, the second bung assembly including a second bung member having a second threaded portion for threadably screwing into said second aperture and further including isolating means for restricting access to said threaded portion and a raised member extending axially outwardly therefrom, said raised member including an intermediate neck portion and a terminal ball portion, the smallest effective diameter of said ball portion exceeding the effective diameter of said neck portion; and a securing bar subassembly for extending between the first bung subassembly and the second bung subassembly, including means for mating with said post member and means for mating with said raised member so as to prevent removal of either of said first or said bung members from the respective apertures when the securing bar subassembly is in mating relationship therewith.

6. The device of claim 5 wherein said first bung member further includes a post support portion secured to said threaded portion and supporting said post portion in such a manner that said post portion is prohibited from moving axially with respect thereto but is free to rotate about said axis.

7. The device of claim 5 wherein said post member includes, at location thereon which extends beyond said isolator member, a lock hole for receiving a lock member therein.

8. The device of claim 5 wherein said isolator member is in the form of a domelike cover member which may rest against the drum surface and an axial tube extending through said domelike cover member for receiving said post member, said axial tube having an inside diameter greater than that of said post member such that said isolator member may spin freely about said axis with respect to said post member.

9. The device of claim 5 wherein said extended portion is rigidly attached to said second threaded portion and said ball portion is provided with an opposing pair of wrench flats such that said extended portion may be gripped thereby for turning said second bung member with respect to the drum.

10. The device of claim 5 wherein said securing bar subassembly includes an elongated securing bar having a flattened bar portion at one end and a tubular portion at the opposing end, said flattened bar portion being adapted to mate with the first bung subassembly and said tubular portion being adapted to mate with the second bung subassembly.

11. The device of claim 10 wherein said flattened portion further includes a wrench aperture for mating with said first bung member so as to provide a leveraging means for turning said first bung member with respect to said drum.

12. The device of claim 10 wherein said flattened portion includes a post receiving hole for slidably receiving said post member and said tubular portion includes a ball receiving structure for receiving said extended portion of the second bung member.

13. The device of claim 13 wherein said tubular portion includes a circular aperture having a diameter greater than that of said ball portion and a sliding channel extending axially endward from said circular aperture, said sliding channel having a width intermediate the smallest effective diameter of said ball portion and the effective diameter of said neck portion, and wherein the distance between the centers of the first and second apertures is greater than the axial separation between said circular aperture and said post receiving hole and less than the axial separation between said post receiving hole and the terminal end of said sliding channel.

14. The device of claim 13 wherein said circular aperture further receives therethrough a portion of said axial tube of said isolator member, and said axial tube is provided with, at a position which extends beyond said flattened portion, a detent ring groove for receiving a hairpin clip for attaching said isolator member to said securing bar.

15. The device of claim 11 wherein said first bung member further includes a post support portion secured to said threaded portion and supporting said post portion in such a manner that said post portion is prohibited from moving axially with respect thereto but is free to rotate about said axis; and said wrench aperture slidably fits about said post support member.

16. A security device adapted for use with multiple aperture surfaces including at least a first aperture and a second aperture arrayed so as to be generally coplanar, comprising;

a first bung member adapted to releasably mate with the first aperture, the first bung member including a first projection which extends therefrom exteriorally from the surface;

a second bung member adapted to releasably mate with the second aperture, the second bung member including a second projection which extends therefrom exteriorally from the surface;

an isolator member for extending over the first bung member and interrelating to the surface in such a manner that the preponderance of the first bung member is inaccessible from the exterior of the isolator member, said first projection extending through the isolator member;

clip means releasably attaching the isolator member to the elongated securing member; and an elongated securing member for extending between the first bung member and the second bung member, the securing member engaging both said first projection and said second projection, with the engagement with one of said projections being inaccessible from the exterior of the engagement member and not subject to disengagement as long as the engagement is maintained with the other of said projections, the engagement with the other of said projections being adapted to securing with a locking means for attaching the securing member in place such that neither aperture is accessible while such attachment is maintained.

* * * * *